US009611767B2

(12) United States Patent
Baltrucki

(10) Patent No.: US 9,611,767 B2
(45) Date of Patent: Apr. 4, 2017

(54) LOST MOTION ASSEMBLY IN A VALVE BRIDGE FOR USE WITH A VALVE TRAIN COMPRISING A HYDRAULIC LASH ADJUSTER

(71) Applicant: Jacobs Vehicle Systems, Inc., Bloomfield, CT (US)

(72) Inventor: Justin Baltrucki, Canton, CT (US)

(73) Assignee: Jacobs Vehicle Systems, Inc., Bloomfield, CT (US)

( * ) Notice: Subject to any disclaimer, the term of this patent is extended or adjusted under 35 U.S.C. 154(b) by 13 days.

(21) Appl. No.: 14/858,644

(22) Filed: Sep. 18, 2015

(65) Prior Publication Data

US 2016/0084122 A1 Mar. 24, 2016

Related U.S. Application Data

(60) Provisional application No. 62/052,069, filed on Sep. 18, 2014.

(51) Int. Cl.

| | |
|---|---|
| ***F01L 9/02*** | (2006.01) |
| ***F01L 1/14*** | (2006.01) |
| ***F01L 1/26*** | (2006.01) |

(52) U.S. Cl.

CPC ..... *F01L 9/023* (2013.01); *F01L 1/14* (2013.01); *F01L 1/26* (2013.01); *F01L 9/02* (2013.01)

(58) Field of Classification Search

CPC ..... F01L 1/14; F01L 1/26; F01L 9/02; F01L 9/023

USPC ..... 123/90.12, 90.13, 90.39

See application file for complete search history.

(56) References Cited

U.S. PATENT DOCUMENTS

| | | | |
|---|---|---|---|
| 5,540,201 | A | 7/1996 | Feucht et al. |
| 5,586,533 | A | 12/1996 | Feucht |
| 6,000,374 | A | 12/1999 | Cosma et al. |
| 6,148,793 | A | 11/2000 | Faletti et al. |

(Continued)

FOREIGN PATENT DOCUMENTS

| | | | |
|---|---|---|---|
| CA | 2174686 | A1 | 12/1996 |
| CN | 102787919 | A | 11/2012 |

(Continued)

OTHER PUBLICATIONS

International Search Report and Written Opinion filed in PCT/US2015/050984; dated Dec. 18, 2015; 14 pgs.

*Primary Examiner* — Ching Chang

(74) *Attorney, Agent, or Firm* — Moreno IP Law LLC

(57) ABSTRACT

In an internal combustion engine comprising two or more engine valves that receive valve actuation motions from a valve actuation motion source via a valve train, which valve train comprises a hydraulic lash adjuster, an apparatus for valve actuation comprises a valve bridge and a lost motion assembly disposed therein. The lost motion assembly comprises a first piston disposed in a first piston bore formed in the valve bridge. The first piston is configured to operatively connect with a component of the valve train. A biasing element is configured to bias the first piston out of the first piston bore with a first force that is greater than a second force applied to the first piston by the hydraulic lash adjuster. A travel limiter is configured to limit travel of the first piston out of the first piston bore to be no greater than a maximum lost motion distance.

15 Claims, 9 Drawing Sheets

(56) References Cited

U.S. PATENT DOCUMENTS

| | | | | |
|---|---|---|---|---|
| 7,509,933 | B2 * | 3/2009 | Dingle | F01L 1/181 123/90.39 |
| 7,673,600 | B2 | 3/2010 | Yang | |
| 7,712,449 | B1 | 5/2010 | Schwoerer | |
| 7,905,208 | B2 | 3/2011 | Ruggiero et al. | |
| 8,578,901 | B2 | 11/2013 | Ruggiero et al. | |
| 2003/0221663 | A1 | 12/2003 | Vanderpoel et al. | |
| 2005/0211206 | A1 | 9/2005 | Ruggiero et al. | |
| 2006/0005796 | A1 | 1/2006 | Janak et al. | |
| 2007/0204818 | A1 | 9/2007 | Dingle | |
| 2008/0006231 | A1 | 1/2008 | Noss et al. | |
| 2009/0288626 | A1 | 11/2009 | Langewisch | |
| 2010/0170471 | A1 | 7/2010 | Yang | |
| 2010/0170472 | A1 | 7/2010 | Yang et al. | |
| 2010/0251983 | A1 | 10/2010 | Meistrick et al. | |
| 2010/0319657 | A1 | 12/2010 | Dodi et al. | |
| 2011/0132298 | A1 | 6/2011 | Ruggiiero et al. | |
| 2011/0197833 | A1 | 8/2011 | Vorih et al. | |
| 2012/0024260 | A1 | 2/2012 | Groth et al. | |
| 2012/0298057 | A1 | 11/2012 | Janak et al. | |
| 2013/0068195 | A1 | 3/2013 | Ruggiero et al. | |
| 2014/0020644 | A1 | 1/2014 | Roberts et al. | |
| 2014/0083381 | A1 | 3/2014 | Roberts et al. | |
| 2015/0144096 | A1 | 5/2015 | Meneely et al. | |
| 2015/0159520 | A1 | 6/2015 | Cecur | |
| 2015/0159521 | A1 | 6/2015 | Baltrucki et al. | |

FOREIGN PATENT DOCUMENTS

| | | | |
|---|---|---|---|
| WO | 9639572 | A1 | 12/1996 |
| WO | 9639573 | A1 | 12/1996 |
| WO | 9639574 | A1 | 12/1996 |
| WO | 9639575 | A1 | 12/1996 |
| WO | 2014006185 | A1 | 1/2014 |

* cited by examiner

LOST MOTION ASSEMBLY IN A VALVE BRIDGE FOR USE WITH A VALVE TRAIN COMPRISING A HYDRAULIC LASH ADJUSTER

CROSS-REFERENCE TO RELATED APPLICATION

The instant application claims the benefit of Provisional U.S. Patent Application Ser. No. 62/052,069 entitled "Integrated Valve Bridge with Hydraulic Lash Adjuster" and filed Sep. 18, 2014, the teachings of which are incorporated herein by this reference.

FIELD

The instant disclosure relates generally to actuation of engine valves in internal combustion engines and, in particular, to a lost motion assembly in a valve bridge for use with a valve train comprising a hydraulic lash adjuster.

BACKGROUND

As known in the art of internal combustion engines, during a cold start of such engines, certain components heat up and may experience thermal expansion. Additionally, over the life of an engine, engine components may wear, and thus change size and shape. Engine poppet valves (engine valves) and the systems used to actuate them (valve trains) are exposed to significant temperature changes and potential wear, and accordingly, these systems must allow for thermal growth and other phenomena that may affect actuation of the engine valves. One technique to accommodate thermal expansion and the like has been to provide a gap or lash space between the engine valve (or a valve bridge that spans two or more engine valves) and the valve train and/or between components of the valve train, such as a rocker arm, cam, push tube, etc. As the components experience thermal expansion, the lash space is taken up providing, ideally, a continuous mechanical connection between the engine valve and corresponding valve train or within the valve train itself. This lash space can be set manually, or in some cases, via an hydraulic lash adjuster between the engine valve and the valve train or within the valve train.

A hydraulic lash adjuster typically includes a sliding plunger within a housing and operated by a continuous supply of hydraulic fluid, such as engine oil. Unidirectional flow of hydraulic fluid into a chamber formed between the sliding plunger and the housing occurs when no actuations are applied to the engine valve, i.e., when the engine valve is closed and no or a relatively low load is placed on the lash adjuster. As the chamber fills with hydraulic fluid, the sliding plunger slides longitudinally within the housing thereby increasing the overall length of the hydraulic lash adjuster and taking up any lash within the valve train and engine valve linkage. On the other hand, when the engine valve is actuated (opened), i.e., a load is placed on the sliding plunger, a hydraulic lock within the chamber prevents the plunger from sliding.

Hydraulic lash adjustors, however, have not been used to adjust lash space between an engine valve and a valve actuation system designed to provide both positive power and auxiliary engine valve events (such as engine braking events) to the extent that such valve actuation systems typically include a so-called lost motion component. In the context of internal combustion engines, lost motion is a term applied to a class of technical solutions for modifying the valve motion dictated by a valve actuation motion source with a variable length mechanical, hydraulic or other linkage assembly. In a lost motion system the valve actuation motion source may provide the maximum dwell (time) and greatest lift motion needed over a full range of engine operating conditions. A variable length system may then be included in the valve train linkage between the valve to be opened and the valve actuation motion source to subtract or "lose" part or all of the motion imparted from the valve actuation motion source to the valve. This variable length system, or lost motion system may, when expanded fully, transmit all of the available motion to the valve and when contracted fully transmit none or a minimum amount of the available motion to the engine valve.

However, if an hydraulic lash adjuster is used in conjunction with a lost motion component, there is a risk that the hydraulic lash adjuster will function to take up available lash during periods of lost motion, thereby resulting in over-extension or "jacking out" of the hydraulic lash adjuster. In turn, this may result in the application of motions to engine valves that are supposed to be lost, thus creating the potential for catastrophic damage to the engine.

Thus, it would be advantageous to provide systems that address these shortcomings of existing systems.

SUMMARY

The instant disclosure describes a lost motion assembly disposed in a valve bridge for use in an internal combustion engine comprising two or more engine valves that receive valve actuation motions from a valve actuation motion source via a valve train, which valve train comprises a hydraulic lash adjuster disposed within the valve train upstream of the lost motion assembly. In particular, the lost motion assembly comprises a first piston disposed in a first piston bore formed in the valve bridge. The first piston is configured to operatively connect with a component of the valve train. A biasing element is provided and configured to bias the first piston out of the first piston bore with a first force that is greater than a second force applied to the first piston (possibly via the valve train) by the hydraulic lash adjuster. The lost motion assembly further comprises a travel limiter configured to limit travel of the first piston out of the first piston bore (due to the force applied by the biasing element), preferably to be no greater than a maximum lost motion distance. In an embodiment, the first piston may comprise an internal cavity configured for fluid communication with a hydraulic fluid supply and further having a check valve disposed therein permitting one-way flow of hydraulic fluid into the internal cavity.

When the hydraulic fluid supply comprises a selectable hydraulic fluid source, a reset assembly may be provided in which a reset valve is disposed in the valve bridge in fluid communication with the first piston bore, and a fixed reaction surface is configured to operatively connect with the reset valve thereby opening and closing the reset valve. Alternatively, the valve bridge may comprise a slave piston disposed within a slave piston bore formed in the valve bridge, and further comprise a hydraulic circuit formed in the valve bridge in fluid communication with both the first piston bore and the slave piston bore. In this case, the reset assembly may comprise a bleed hole in fluid communication with the slave piston bore and a fixed reaction surface configured to provide selective sealing engagement with the bleed hole. In other embodiments, the hydraulic fluid supply may comprise a constant hydraulic fluid source. In this instance, the reset assembly may comprise a reset valve disposed in the valve bridge in fluid communication with the first piston bore, and an actuator configured to selectively open and close the reset valve.

In an embodiment, the hydraulic fluid supply to the lost motion assembly is provided via a component of the valve train and is further configured independent of another hydraulic fluid supply for the hydraulic lash adjuster. However, in another embodiment, the hydraulic fluid assembly is provided by a component of the valve train, but is further configured to also supply hydraulic fluid to the hydraulic lash adjuster. In this embodiment, the hydraulic lash adjuster may comprise a lash adjuster housing have a lash piston bore formed therein and in configured for hydraulic communication with the hydraulic fluid supply. A lash piston is slidably disposed with the lash piston bore and forms a chamber between the lash adjuster housing and the lash piston. The lash piston also has an internal cavity configured for fluid communication with the hydraulic fluid source, and an opening between the internal cavity and the chamber. A check valve is disposed in the chamber and configured to permit one-way flow of hydraulic fluid via the lash piston bore, internal cavity and opening into the chamber. The lash adjuster housing further comprises a first hydraulic fluid passage configured for fluid communication with the hydraulic fluid supply. The first hydraulic fluid passage is further configured to bypass the lash piston bore, lash piston and check valve to provide hydraulic fluid to an output port configured for fluid communication with the lost motion assembly. In an embodiment, the valve train comprises a rocker arm having a second hydraulic fluid passage and a lash adjuster bore formed in the rocker arm. In this embodiment, the lash adjuster housing is disposed within the lash adjuster bore such that the second hydraulic fluid passage serves as the hydraulic fluid supply to the first hydraulic fluid passage. Further this embodiment, the lash adjuster housing may comprise a side wall having an opening formed therein such that the first hydraulic fluid passage is configured for fluid communication with the second hydraulic fluid passage via the opening formed in the side wall. Further still, the lash adjuster bore may comprise a lateral hydraulic fluid passage formed in and extending axially along a wall defining the lash adjuster bore such that the lateral hydraulic fluid passage provide fluid communication from the second hydraulic fluid passage to the lash adjuster bore. In this instance, the lateral hydraulic fluid passage may be configured such that hydraulic fluid from the second hydraulic fluid passage flows more readily through the first hydraulic fluid passage than the lateral hydraulic fluid passage.

BRIEF DESCRIPTION OF THE DRAWINGS

The features described in this disclosure are set forth with particularity in the appended claims. These features and attendant advantages will become apparent from consideration of the following detailed description, taken in conjunction with the accompanying drawings. One or more embodiments are now described, by way of example only, with reference to the accompanying drawings wherein like reference numerals represent like elements and in which:

DETAILED DESCRIPTION OF THE PRESENT EMBODIMENTS

Figure 1:
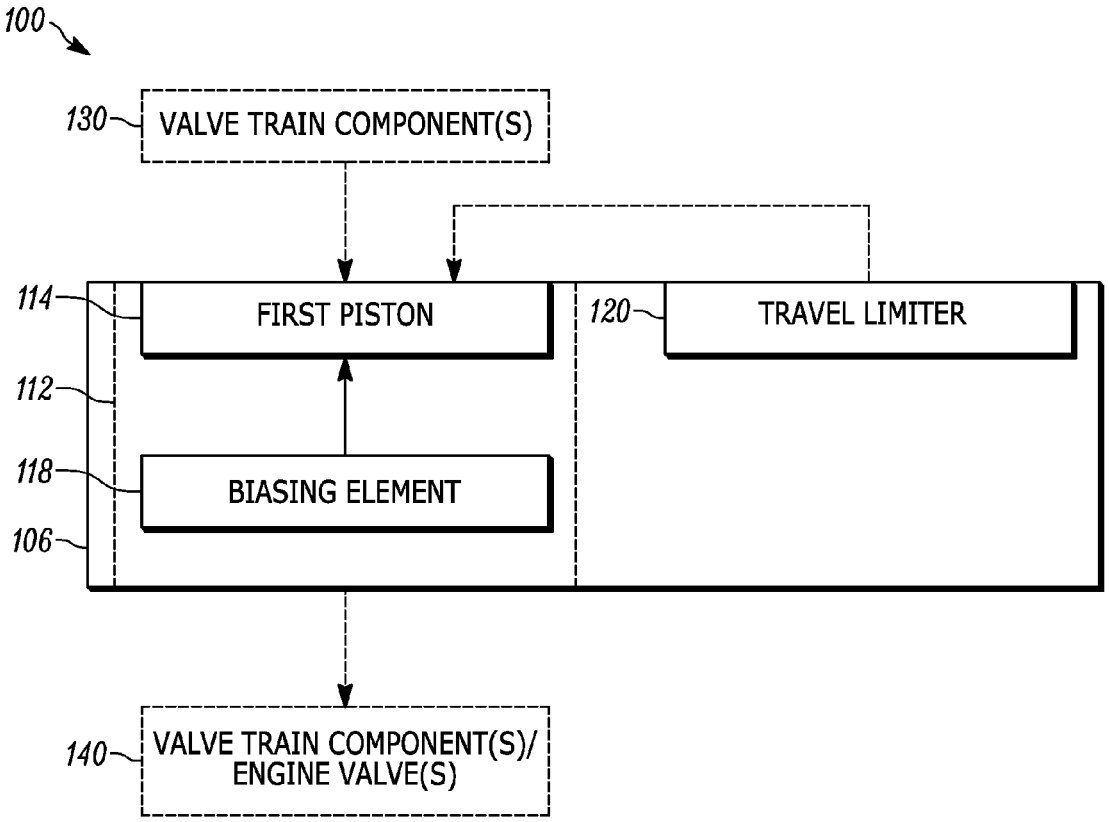
FIG. 1 is a schematic block diagram of a lost motion assembly in accordance with the instant disclosure.

Referring now to FIG. 1, a lost motion assembly 100 in accordance with the instant disclosure comprises a lost motion housing 106 having a first piston bore 112 formed therein, and a first piston 114 disposed in the first piston bore 114. Generally, the lost motion housing 106 may be embodied by any component of a valve train, e.g., a push rod, rocker arm, valve bridge, etc. However, for purposes of illustration, various implementation are described below in which the lost motion housing 106 is embodied by a valve bridge. As known in the art, the first piston 114 may be configured (as illustrated in various embodiments below) such that selective application of hydraulic fluid thereto may permit the first piston 114 to shift between a mode of operation in which it causes all valve actuation motions (including any auxiliary valve actuation motions) applied thereto to be transmitted through, or another mode in which some or all of such valve actuation motions are lost. Generally, the amount of valve actuation motion that the first piston 114 is capable of losing is limited in some fashion to some maximum distance, e.g., on the order of a few millimeters or less. For example, when losing motion, the first piston 114 may be free to travel into the first piston bore 114 by any amount less than the maximum lost motion distance, whereas valve actuation motions that cause displacement of the first piston 114 more than the maximum lost motion distance will cause the first piston 114 to make solid contact with the lost motion housing 106 (e.g., with a shoulder or the like formed in the first piston bore 112), thereby transmitting such motions through the lost motion housing 106.

For purposes of illustration, and not limitation, FIG. 1 also illustrates one or more upstream valve train components 130 as well as one or more downstream valve train components or engine valves 140, which valve train components may include any of the well-known components described above.

As used herein, the terms "upstream" and "downstream" are relative to the direction from a valve actuation motion source toward one or more engine valves. Though not illustrated in FIG. 1, a hydraulic lash adjuster may be deployed within or between any of the valve train components 130, 140 using techniques known in the art. Hydraulic lash adjusters in accordance with the instant disclosure are described in further detail below.

As further shown in FIG. 1, a biasing element 118 is operatively connected to the first piston 114 and configured to bias the first piston 114 out of the first piston bore 114. Although the biasing element 118 is illustrated in FIG. 1 as being deployed within the first piston bore 112, it is noted that this is not a requirement. For example, the first piston 114 could comprise a feature such a lip or flange that permits engagement with the biasing element 118, thereby permitting the biasing element 118 to be deployed outside of the first piston bore 112. Generally, the biasing element 118 may comprise any suitable type of spring, e.g., a coil spring, leaf spring, resiliently deformable material, etc. As described in further detail below, the biasing element 118 is preferably chosen such that a first force it applies to the first piston 114 will be greater than a second force applied to the first piston 114 by a hydraulic lash adjuster deployed within a valve train that cooperates with the lost motion assembly.

A travel limiter 120 is also provided to limit the distance that the first piston 114 may be displaced out of the first piston bore 112, particularly in response to the force applied by the biasing element 118 to the first piston 114. For example, the travel limiter 120 may be configured such that it provides solid contact with the first piston 114 when it has traveled a predetermined distance out of the first piston bore 114. In an embodiment, the travel limiter 120 is configured to limit travel of the first piston 114 to be no greater than the maximum lost motion distance to be provided by the lost motion assembly 100, various examples of which will be further described below. As used herein, the term maximum lost motion distance is understood to include not only the greatest distance of motion intended to be lost in given system, but also to account for any compliance in the valve train (i.e., the amount of deflection that occurs in the mechanical and hydraulic components in the valve train load path when subjected to the force from the valve springs) such that the travel limiter 120 does not interfere with full closing of engine valves. Additionally, though the travel limiter 120 is illustrated in FIG. 1 as being a constituent component of, or integrated into, the valve bridge 106, this is not a requirement. For example, in various embodiments described below, the travel limiter 120 may comprise a component that is mounted on an exterior surface of the valve bridge 106 and partially intersecting a volume of space that the first piston 114 can be expected to move within as it is displaced out of the first piston bore 112. Alternatively, the travel limiter 120 may be apart from the valve bridge 106, as in the case of a fixed contact surface (e.g., integral to an overhead fixture or similar structure) positioned in proximity thereto and configured to limit travel of the first piston 114.

Figure 2:
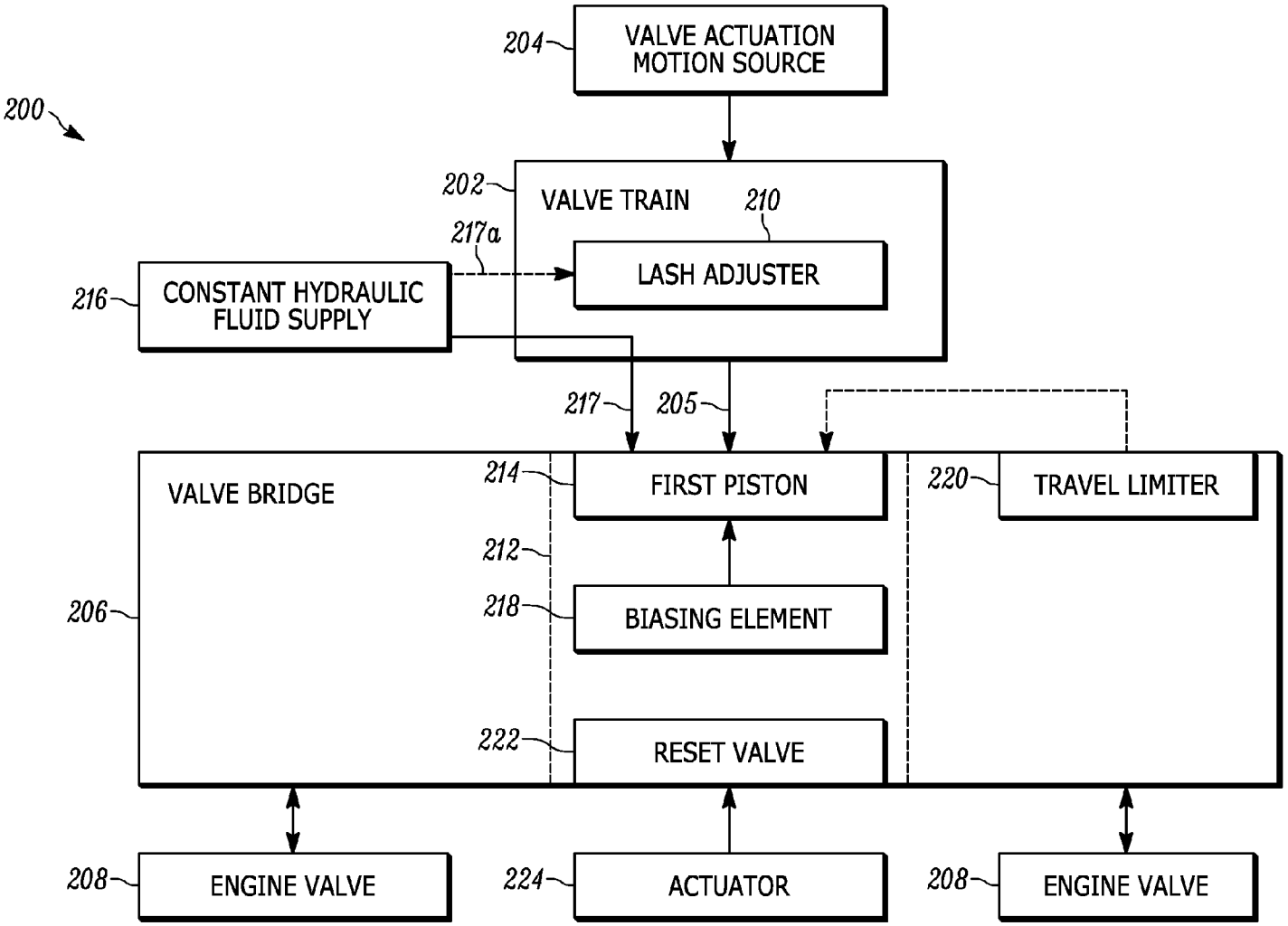
FIG. 2 is schematic block diagram of a system comprising a constant hydraulic fluid supply and further comprising a lost motion assembly in accordance with the instant disclosure disposed within a valve bridge.

FIG. 2 illustrates a system 200 comprising a constant hydraulic fluid supply 216 and further comprising a lost motion assembly, substantially as described above, disposed within a valve bridge 206. As shown, the system 200 comprises a valve train 202 that is operatively connected at one end to a valve actuation motion source 204, and to the valve bridge 206 at its other end. As described above, the valve train 202 may comprise one or more components of the type commonly employed in the art. Likewise, the valve actuation motion source 204 may comprise any mechanism known in the art for originating valve actuation motions, e.g., a cam residing on a cam shaft or a suitably controlled actuator. As further shown, a hydraulic lash adjuster 210 is deployed within the valve train 202 according to well-known techniques, except as described in further detail below. For example, the hydraulic lash adjuster may be deployed within either the motion receiving or motion imparting ends of a rocker arm, a push rod, cam follower, etc. In the illustrated embodiment, the constant hydraulic fluid supply 216, which may comprise a non-switched engine oil supply line or the like, provides hydraulic fluid 217 to the valve bridge 206, specifically, the first piston 214 (via hydraulic components and features of the first piston 214 not illustrated) and additionally provides, in this embodiment, hydraulic fluid 217*a*, to the hydraulic lash adjuster 210. As described below, when supplying both the valve bridge 206 and hydraulic lash adjuster 210, the constant hydraulic fluid supply 216 may be configured such that it provides hydraulic fluid 217, 217*a* to either destination preferentially relative to the other destination. Additionally, the valve train 202 conveys valve actuation motions 205 received from the valve actuation motion source 204 to the valve bridge 206 via the first piston 214.

Additionally shown in FIG. 2, the valve bridge 206 is operatively connected to two or more engine valves 208 in accordance with known techniques. In this manner, valve actuation motions applied to the valve bridge 206 may be transferred to the two or more engine valves 208 and, likewise, valve closing forces conveyed by the engine valves 208 (via valve springs not shown) may be transferred back to the valve bridge 206. Further, the valve bridge 206 comprises a lost motion assembly, as described above relative to FIG. 1, comprising a first piston bore 212 and first piston 214 disposed therein, a biasing element 218 configured to bias the first piston 214 out of the first piston bore 212 and a travel limiter 220 configured to limit displacement of the first piston 214 as before. In the embodiment of FIG. 2, however, the valve bridge 206 further includes a reset assembly comprising a reset valve 222 in fluid communication with the first piston bore 212 and an actuator 224 configured to selective open and close the reset valve 222. As known in the art, the lost motion assembly is able to transfer otherwise lost valve actuation motions when a hydraulic lock is established in the first piston bore 212 (by virtue of a check valve deployed in the first piston 214; not shown). However, it is sometimes desirable to quickly revert to a lost motion mode of operation such that only a part of the available valve actuation motions are conveyed. To this end, the reset valve 222 may comprise a valve that provides sealing engagement with first piston bore 212 (optionally with the assistance of a biasing element, not shown), particularly when hydraulic lock is established. Under control of the actuator 224 (which may comprise any suitably controlled actuator, e.g., hydraulic, pneumatic, electrical), the sealing engagement of the reset valve 222 may be discontinued thereby permitting the otherwise hydraulically locked fluid to rapidly escape and causing any subsequent valve action motions (subject to the maximum lost motion distance of the system 200) to be lost.

Additionally, as noted above, the biasing element 218 provides a first force on the first piston 214 that is greater than a second force applied to the first piston 214 by the hydraulic lash adjuster 210. For example, in a typical hydraulic lash adjuster, the total expansion force that may be applied by the hydraulic lash adjuster 210 is the sum of (i) the pressure of the hydraulic fluid 217*a* multiplied by the cross-sectional area of the hydraulic lash adjuster 210 upon which the hydraulic fluid 217*a* acts and (ii) the force applied by any expansion spring provided in the hydraulic lash adjuster 210. Assuming that the pressure of the hydraulic fluid 217 supplied to the first piston 214 (and thereby biasing it out of the first piston bore 212 as the first piston bore 212 fills with hydraulic fluid) is essentially equal to the pressure of the hydraulic fluid 217*a* supplied to the hydraulic lash adjuster 210, and further assuming the cross-sectional area of the first piston 214 acted upon by the hydraulic fluid 217 is also essentially equal to that of the hydraulic lash adjuster 210, the biasing element 218 may be selected to provide a first force that is greater than any force applied by an expansion spring in the hydraulic lash adjuster 210. In this scenario, the force of the biasing element 218 is preferably slightly higher than the force of the expansion spring though, in practice, the amount that the force of the biasing element 218 is greater than the force of the expansion spring will vary according to the application. For example, having the force of the biasing element 218 exceed that of the expansion spring by approximately 20% may be sufficient in many cases. As a maximum, it may be desirable to limit the force of the biasing element 118 to not exceed the force applied by the hydraulic fluid 217 acting on the cross-sectional area of the first piston 214. Regardless, in this manner, the first piston 214 is always biased out of the first piston bore 212 with at least enough force to prevent expansion of the hydraulic lash adjuster 210, thereby prevent over-extension or jacking of the hydraulic lash adjuster 210 during periods of lost motion operating mode of the lost motion assembly. However, by limiting outward displacement of the first piston 214 by virtue of the travel limiter 220, the force applied by the biasing element 218 is prevented from causing the hydraulic lash adjuster 210 to over-compress, thereby creating unwanted lash space between components. Additionally, the first force should be sufficiently low (yet still greater than the hydraulic lash adjuster force as described above) so that any valve actuation motions 205 applied to the first piston 214 can overcome the force applied by the biasing element 218 to the first piston 214, thereby allowing them to be transmitted, when necessary, through the lost motion assembly.

Figure 3:
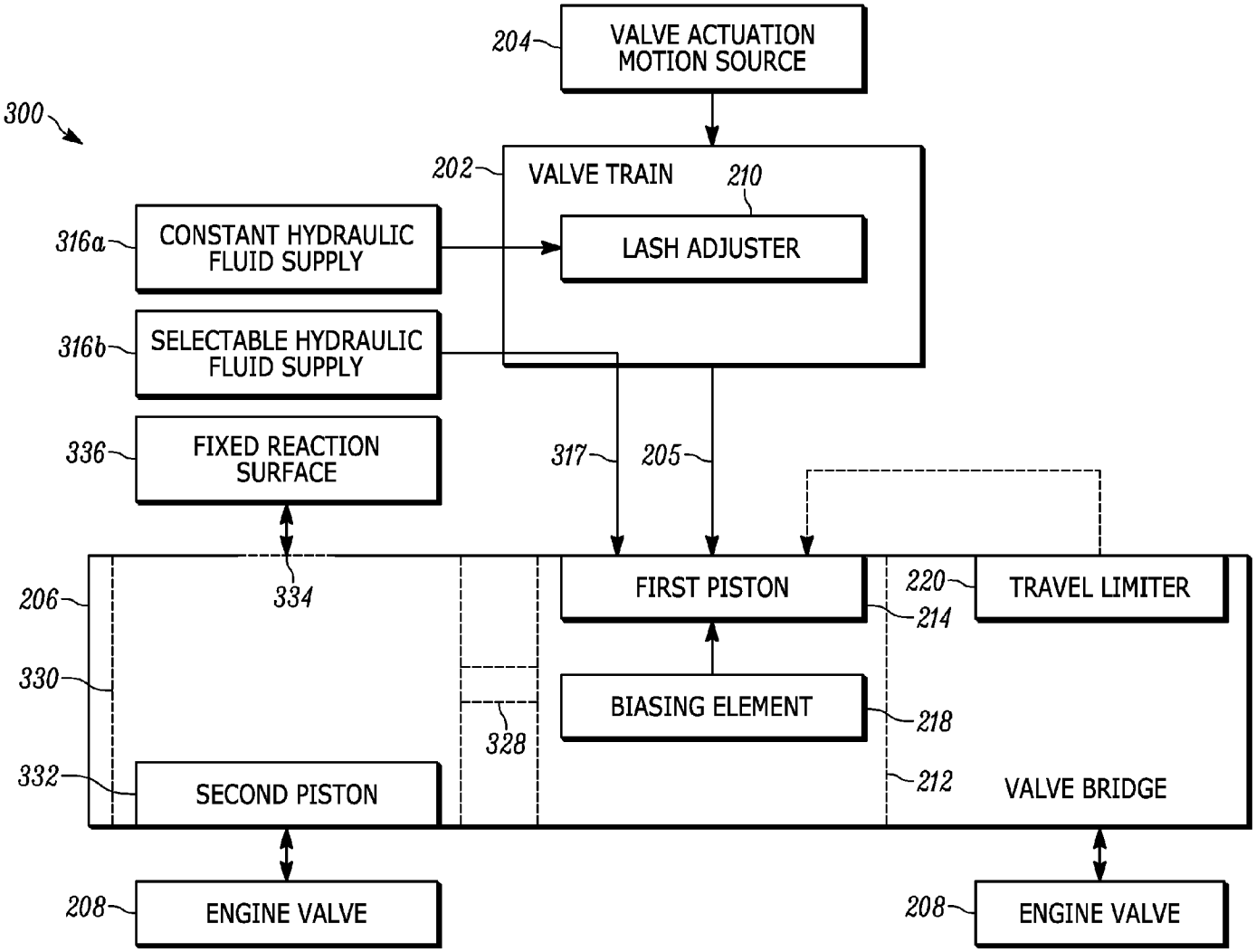
FIG. 3 is a is schematic block diagram of a system comprising a selectable hydraulic fluid supply and further comprising a lost motion assembly in accordance with the instant disclosure disposed within a valve bridge.

Referring now to FIG. 3, a system 300 is illustrated in which like-numbered components from FIG. 2 are configured and operate in essentially the same manner as described above. As shown, however, the system 300 includes a number of distinguishing features, including both a constant hydraulic fluid supply 316*a* and a selectable hydraulic fluid supply 316*b*. In this instance, a constant hydraulic fluid supply 316*a*, as described above, is configured to supply hydraulic fluid to only (relative to the components illustrated in FIG. 3; in practice, many other components may be thus supplied) the hydraulic lash adjuster 210. In contrast, the hydraulic fluid 317 supplied to the first piston 214 is provided by the selectable hydraulic fluid supply 316*b*, which may comprise a hydraulic fluid passage or the like in which flow of hydraulic fluid therein is controlled by a suitable solenoid valve or the like that may be selectively opened and closed to control the flow. The lost motion assembly of FIG. 3, like that of FIG. 2, includes the first piston bore 212, first piston 214, biasing element 218 and travel limiter 220 as described above.

As further shown in FIG. 3, however, the valve bridge 206 further comprise a second or slave piston bore 330 that is in fluid communication with the first piston bore 212 via a hydraulic circuit 328 formed in the valve bridge 206. Additionally, a reset assembly is provided via a bleed hole 334 formed in fluid communication with the slave piston bore 330, as well as a fixed reaction surface 336, e.g., a surface that is unmoving relative to, in this case, movement of the valve bridge 206, that is configured to operatively connect with the bleed hole 334, thereby selectively providing sealing engagement with the bleed hold 334. Generally, when the engine valves 208 are closed under the bias of the valve springs (not shown), the valve bridge 206 is likewise biased into contact with the fixed reaction surface 336. A second or slave piston 332 is disposed in the slave piston bore 330 and configured, as shown, to operatively connect with a first of the at least two engine valves 208. Generally, the slave piston 332 can travel (and is often biased) into the slave piston bore 330 only a limited distance such that the slave piston 332 will make solid contact with the valve bridge 206, thereby permitting at least some valve actuation motions 205 to be conveyed to the first engine valve 208 when the lost motion assembly is operating in a lost motion mode, i.e., losing some, but not necessarily all, valve actuation motions.

As known in the art, as the first piston bore 212 is charged with hydraulic fluid, the hydraulic fluid is free to charge the slave piston bore 330 as well (and possibly extending the slave piston 332 out of its bore 330). As valve actuation motions 205 are applied to the first piston 214, the hydraulic lock established between the first piston 214 and the slave piston 332 via the first piston bore 212, hydraulic circuit 328 and slave piston bore 330 requires that such valve actuation motions are likewise applied to the slave piston 332 and, consequently, the first engine valve 208, up to the maximum lost motion distance that the first piston 214 is able to travel into the first piston bore 212. Further valve actuation motions 205 beyond the maximum lost motion distance thereafter cause the first piston 214 to establish solid contact with the valve bridge 206, thereby applying the valve actuation motions to the entire valve bridge 206 and, consequently, to the at least two engine valves 208. As the valve bridge 206 moves in this manner, the sealing engagement between the fixed reaction surface 336 and the bleed hole 334 is broken, thereby permitting the hydraulically locked fluid in the slave piston bore to rapidly escape, thereby resuming lost motion operation.

Figure 4:
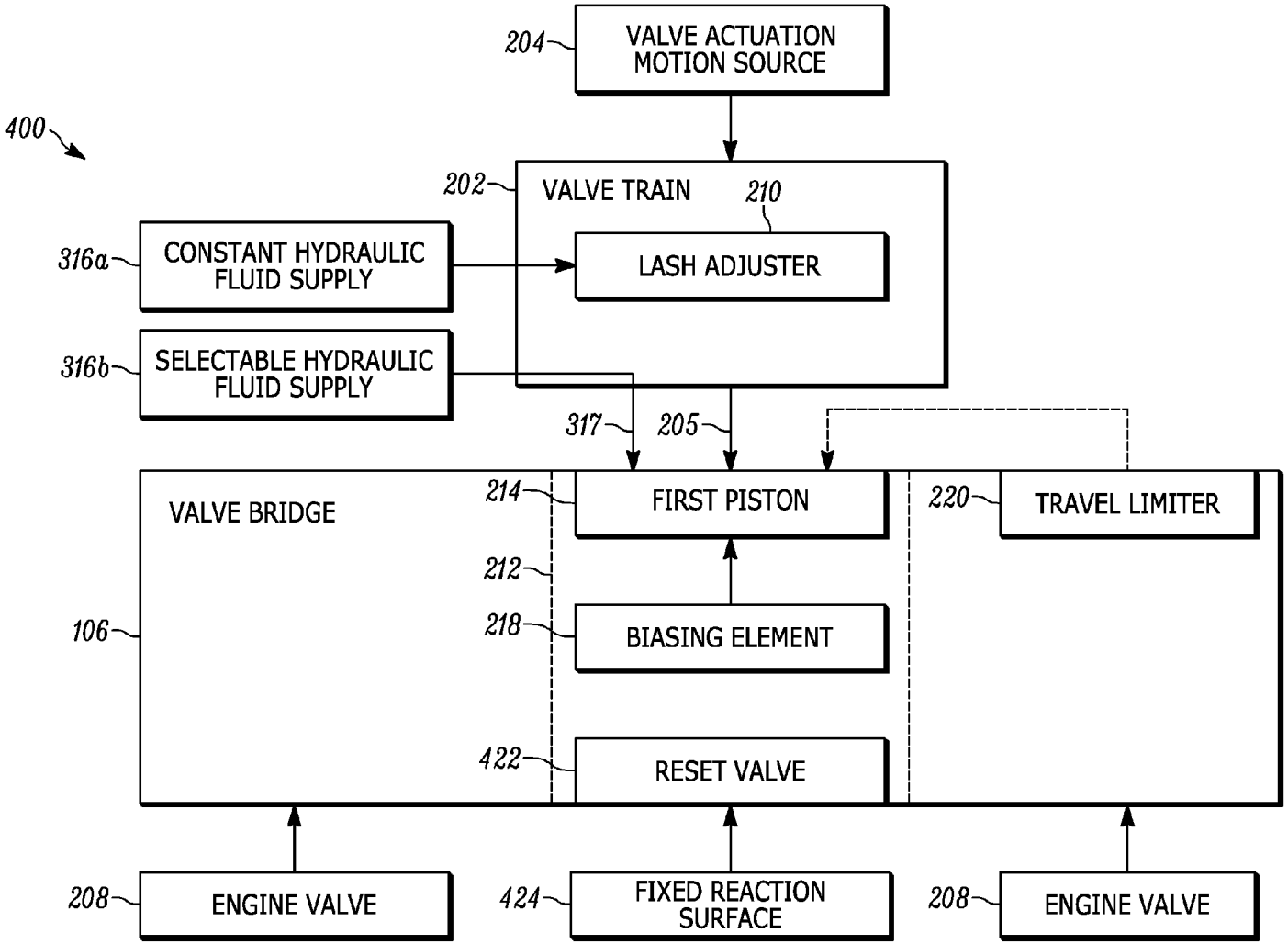
FIG. 4 is a is schematic block diagram of another system comprising a selectable hydraulic fluid supply and further comprising a lost motion assembly in accordance with the instant disclosure disposed within a valve bridge.

FIG. 4 illustrates a system in which in which like-numbered components from FIGS. 2 and 3 are configured and operate in essentially the same manner as described above. In this system 400, no slave piston bore, 330, slave piston 332, bleed hole 334 or fixed reaction surface 336 are provided. Instead, a reset valve 422, substantially similar to the reset valve 222 described above relative to FIG. 2, is provided in fluid communication with the first piston bore 212. Further, a fixed reaction surface 424 is provided that operatively connects with the reset valve 422.

It is noted that the configuration and operation of the biasing element 218 in FIGS. 3 and 4 is substantially similar to that described relative to FIG. 2 above, i.e., preventing over-extension or jacking of the hydraulic lash adjuster 210.

Figure 5:
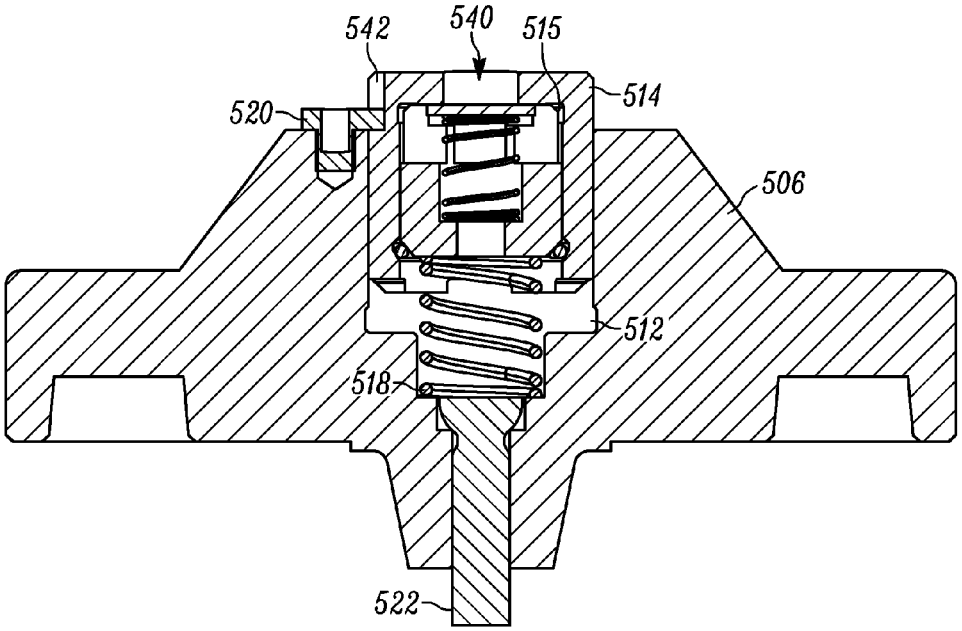
FIG. 5 illustrates an implementation of a valve bridge comprising a lost motion assembly in accordance with the instant disclosure and the system of FIG. 2.

Referring now to FIG. 5, an implementation of a valve bridge 406 comprising a lost motion assembly in accordance with the instant disclosure and the system 200 of FIG. 2 is further illustrated. In particular, the lost motion assembly comprises a first piston 514 disposed in a first piston bore 512 and a biasing element 418 disposed within the first piston bore 512 and biasing the first piston 514 out of the first piston bore 512. A reset valve 522, which may be selectively opened and closed under the direction of an actuator (not shown), is provided in fluid communication with the first piston bore 512. Likewise, a travel limiter 520 is provided, in this embodiment, as a screw component having a flanged head that is wide enough to engage a shoulder 542 formed in a wall of the first piston 514. In this implementation, the first piston 514 comprises an internal cavity 515 that is configured for fluid communication with the hydraulic fluid supply (not shown) that would supply hydraulic fluid to an opening in the top of the first piston 514. A check valve 540, known in the art to comprise a check ball or plate that is biased into sealing engagement with opening in the top of the first piston 414, is disposed within the internal cavity 515, thereby permitting only one-way flow of hydraulic fluid into the internal cavity 515 and the first piston bore 512.

Figure 6:
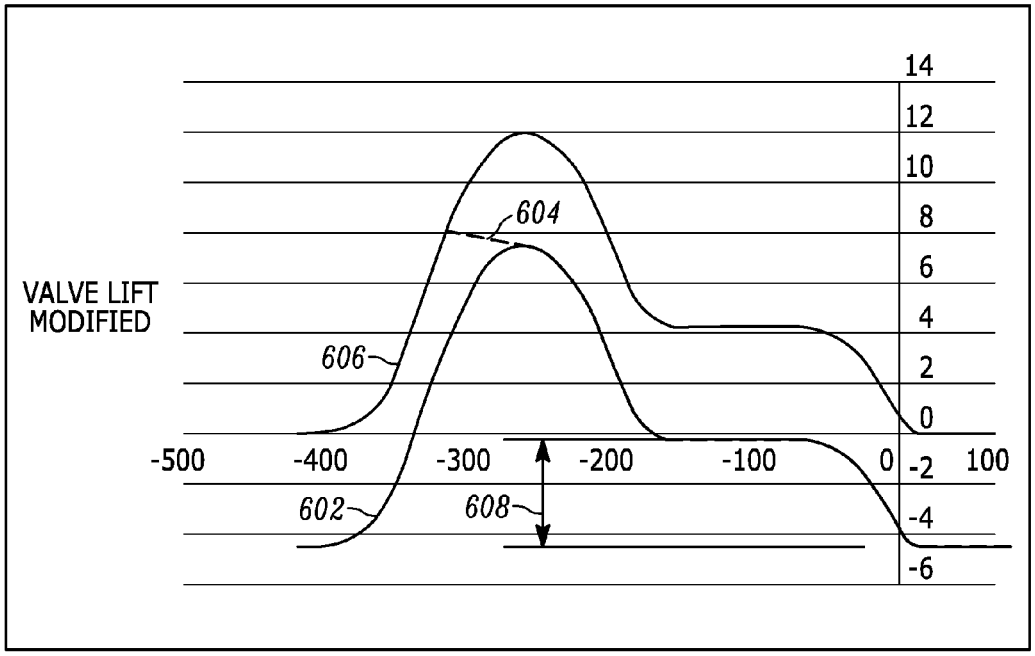
FIG. 6 illustrates exemplary valve lifts that may be used in conjunction with the implementation of FIG. 5.

As best shown in FIG. 6, the travel of the first piston 514 out of the first piston bore is limited to a maximum lost motion distance 608. When the first piston bore 512 is charged with hydraulic fluid, the first piston is hydraulically locked in its extended position, thereby permitting the upper valve lift profile 606 to be transmitted to the valve. In the illustrated example, the upper valve lift profile 606 comprise a so-called Miller cycle valve lift profile as may be applied to intake engine valves. When an actuator (not shown) under the reset pin 522 is selectively extended in order to generate a lost motion profile, the valve lift will reduce at the point of contact between the reset pin 522 and the actuator as shows by the dashed line 604 in FIG. 6. The hydraulically locked fluid in the first piston bore 512 is released thereby allowing the first piston 514 to collapse to a lower valve lift profile 602 resulting in a shorter valve profile. After the lower valve lift profile has been completed, the supply of hydraulic fluid through the check valve 540 will refill the first piston bore 512 and hydraulically lock the first piston 514 in its extended position prior to the start of the next valve lift event. This allows for a selective closing timing of the valve event with an unmodified opening timing as is sometimes desired for intake valves.

Figure 7:
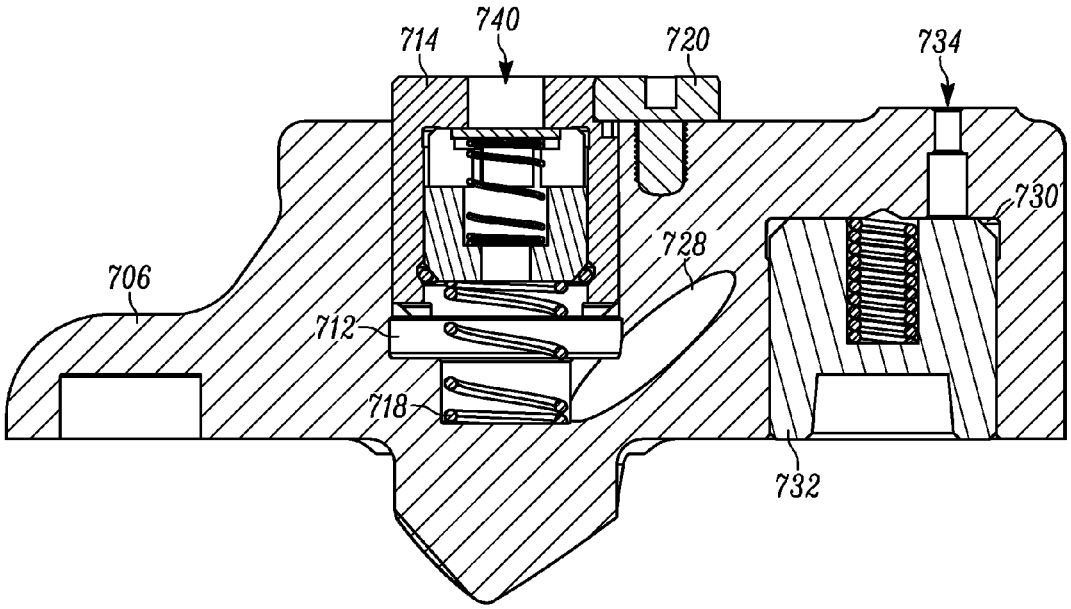
FIG. 7 illustrates an implementation of a valve bridge comprising a lost motion assembly in accordance with the instant disclosure and the system of FIG. 3.

Referring now to FIG. 7, an implementation of a valve bridge 706 comprising a lost motion assembly in accordance with the instant disclosure and the system 300 of FIG. 3 is further illustrated. In particular, the lost motion assembly comprises a first piston 714 disposed in a first piston bore 712 and a biasing element 718 disposed within the first piston bore 712 and biasing the first piston 714 out of the first piston bore 712. As in FIG. 5, a travel limiter 720 is provided in the form of a screw component having a flanged head that is wide enough to engage a shoulder formed in a wall of the first piston 714. Furthermore, as in FIG. 5, the first piston 714 comprises an internal cavity having a check valve 740 disposed therein. A hydraulic circuit 728 (partially shown) provides fluid communication between the first piston bore 712 and slave piston bore 730. Further, a bleed hole 734 is provided in fluid communication with the slave piston bore 730 and a slave piston 732 is disposed in the slave piston bore 730. An example of valve actuation motions that may be implemented according to the embodiment of FIG. 7 is further illustrated in FIG. 8.

Figure 8:
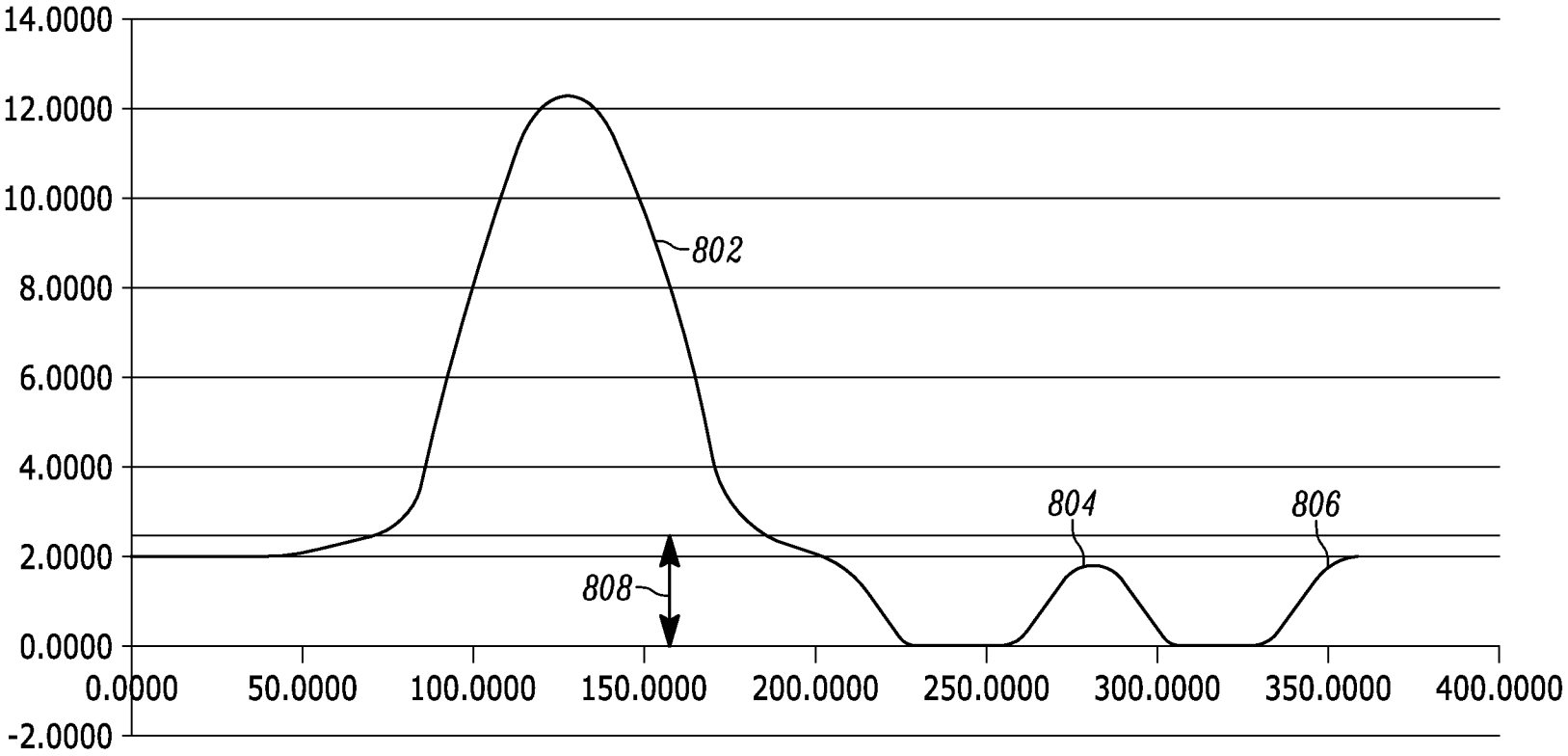
FIG. 8 illustrates exemplary valve lifts that may be used in conjunction with the implementation of FIG. 7.

In FIG. 8, a valve lift profile (covering a full rotation of a camshaft) is illustrated comprising a main event opening 802 followed by two lost motion events 804, 706, i.e., valve lift events that are lost during lost motion operation of the valve bridge 706. During lost motion operation, i.e., when the first piston bore 712 is not selectively charged with hydraulic fluid, the first piston 614 is free to travel up to the maximum lost motion distance 808 into the first piston bore, thereby causing the two lost motion events 804, 806 to not be transmitted through the valve bridge 706, i.e., lost. Oppositely, when the first piston bore 712 is selectively charged with hydraulic fluid, thereby hydraulically locking the first position 714 in its extended position, the lost motion events 804, 806 are transferred from the first piston 714 via the hydraulically locked fluid in the circuit 6728 to the slave piston 732. Subsequent valve actuation motions greater than the maximum lost motion distance 808, i.e., the main event 802, will induce movement of the valve bridge 706 thereby permitting release of the hydraulically locked fluid via the bleed hole 734, thereby allowing the slave piston 732 to collapse and preventing over-extension of the engine valve.

Figure 9:
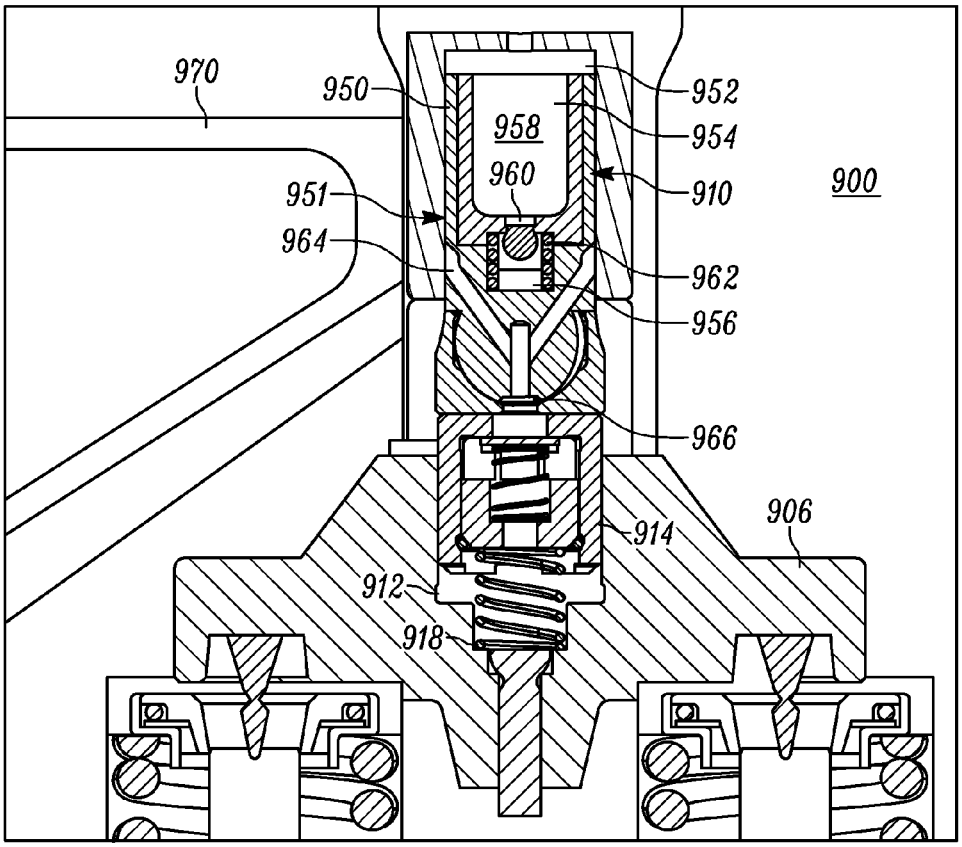
FIG. 9 further illustrates the implementation of FIG. 5 in conjunction with a hydraulic lash adjuster having a first hydraulic fluid passage permitting simultaneous supply of hydraulic fluid to the hydraulic lash adjuster and the lost motion assembly from a constant hydraulic fluid supply.
Figure 10:
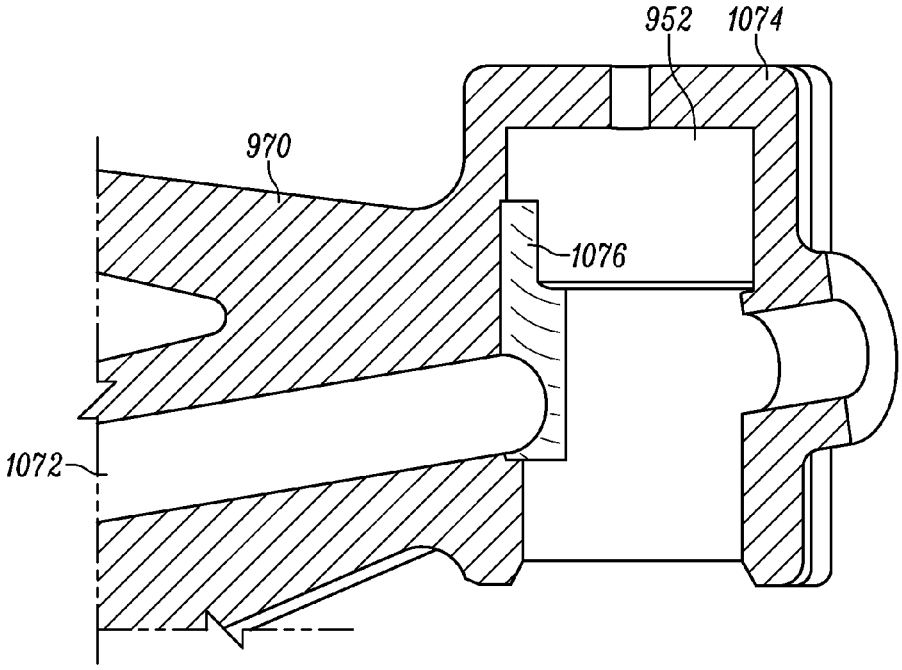
FIG. 10 illustrates implementation of a rocker arm having a second hydraulic fluid passage and a lash adjuster bore formed therein, as well as a lateral hydraulic fluid passage formed in a wall defining the lash adjuster bore.

FIGS. 9 and 10 illustrate a system 900 in accordance with the implementation of FIG. 5 and comprising a hydraulic fluid supply that simultaneously provides hydraulic fluid to the lost motion assembly as well as a hydraulic lash adjuster 910. In particular, the system 900 comprises a valve bridge 906 having a first piston 912 disposed in a first piston bore 914, and a first biasing element 918 substantially similar to the implementation of FIG. 5. The system 900 further comprises a rocker arm 970 having a lash adjuster bore 852 formed in a motion imparting end of the rocker arm 970. Though not shown in FIG. 9, the rocker arm 970 further comprises a (second) hydraulic fluid passage in fluid communication with the lash adjuster bore 952, as described in further detail below relative to FIG. 10.

The lash adjuster 910 is slidably disposed within the lash adjuster bore 952, and comprises a lash adjuster housing 950 having a lash piston bore 951 formed therein. A lash piston 954 is slidably disposed in the lash piston bore 951. As shown, the lash adjuster housing 950 and lash piston 954 form a chamber 956 therebetween. The lash piston 954 further includes an opening 960 permitting fluid communication between the internal cavity 958 and the chamber 956. A check valve 962 is disposed within the chamber 956, thereby permitting one-way flow of hydraulic fluid through the lash piston bore 951, internal cavity 958 and the opening 960 into the chamber 956. As further shown, the lash adjuster housing 950 in this implementation comprises a first hydraulic passage 964 configured for fluid communication with the hydraulic fluid supply provided by the rocker arm, i.e., the second hydraulic fluid passage (not shown). In the illustrated embodiment, the lash adjuster housing 950 comprises a side wall, with the first hydraulic fluid passage 964 communicating with the hydraulic fluid supply via an opening formed in the side wall. At its other end, the first hydraulic passage 964 terminates in an output port 966 configured for fluid communication with the lost motion assembly, specifically, the first piston 914 as previously described. Because the first hydraulic fluid passage bypasses the lash piston bore 951, lash piston 954 and check valve 962, the hydraulic fluid supply is able to simultaneously supply hydraulic fluid to both the lash adjuster 910 and the lost motion assembly.

Further details of the rocker arm 970 are further shown in FIG. 10. In particular, as shown in FIG. 10, a wall 1074 defines the lash adjuster bore 952 in the rocker arm 970. Furthermore, the rocker arm 970 may comprise a second hydraulic fluid passage 1072 that terminates at the lash adjuster bore 952, as shown. In practice, the second hydraulic fluid passage 1072 may be in fluid communication with another hydraulic fluid passage formed in a rocker shaft (not shown) used to support the rocker arm 970, as known in the art. Regardless, in order to supply hydraulic fluid to the lost motion assembly of FIG. 9, the second hydraulic fluid passage 1072 is configured to terminate at a point along the lash adjuster bore 952 such that the first hydraulic passage of the lash adjuster housing 950 is aligned therewith. In order to further supply hydraulic fluid to the lash adjuster 910, a lateral hydraulic fluid passage 1076 is formed in and extends axially along the wall 1074 defining the lash adjuster bore 952. The lateral hydraulic fluid passage 1076 is of sufficient length to establish fluid communication with the internal cavity 958 of the lash piston 954, as described above. In the embodiment of FIG. 10, the cross-sectional areas of the lateral hydraulic fluid passage 1076 may be chosen such that flow of fluid into the first hydraulic fluid passage 964 is more readily achieved than through the lateral hydraulic fluid passage 1076.

Figure 11:
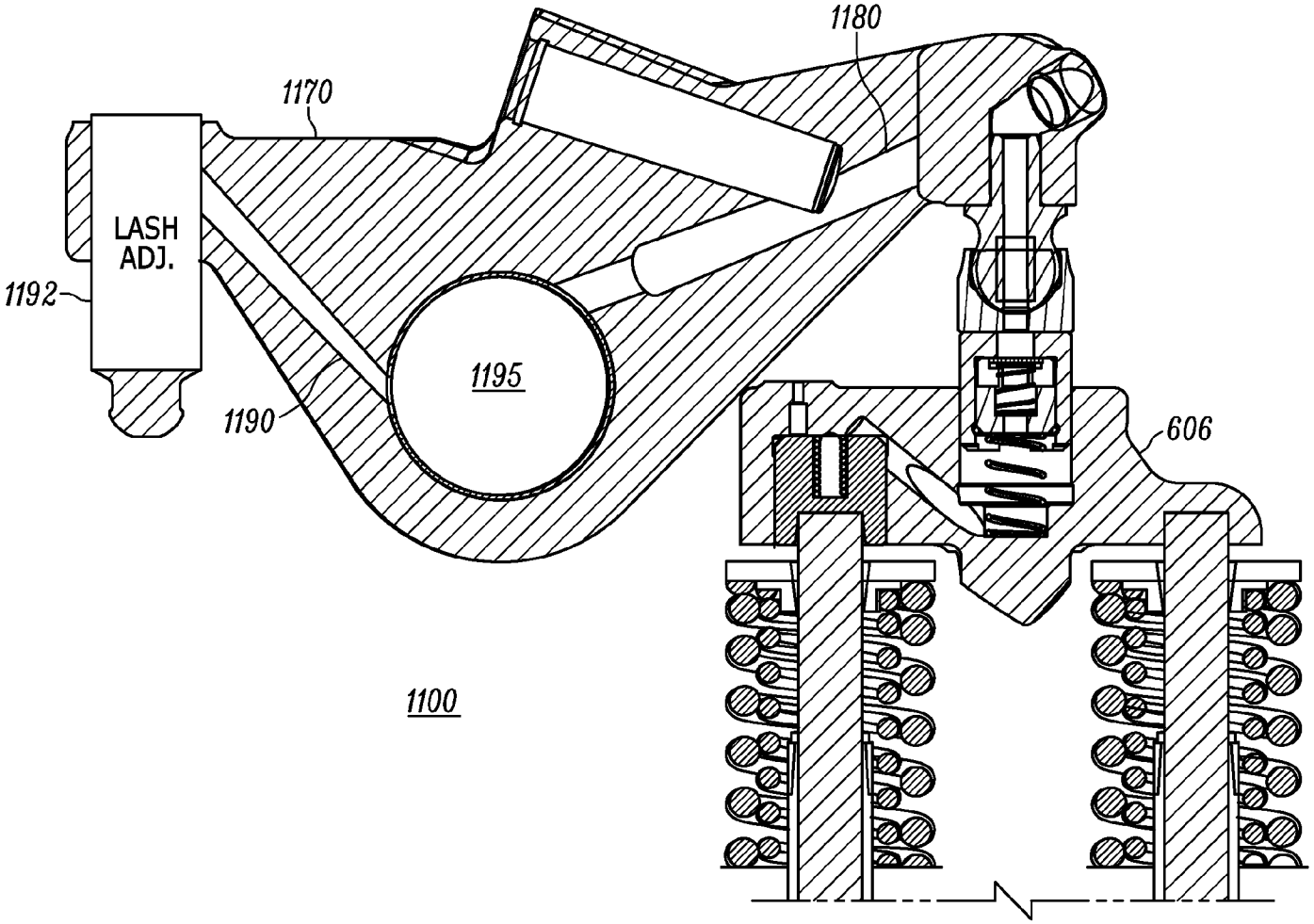
FIG. 11 further illustrates the implementation of FIG. 6 in conjunction with a constant hydraulic fluid supply to the lash adjuster and a selectable hydraulic fluid supply to the lost motion assembly.

FIG. 11 further illustrates a system 1100 in accordance with the implementation of FIG. 7 and comprising both a constant hydraulic fluid supply 1190 and a selectable hydraulic fluid supply 1180. As shown, the system 1100 includes a valve bridge 706 in accordance with the implementation of FIG. 7, including the above-described lost motion assembly. In this case, the system 1100 further comprises a rocker arm 1170 provided with a hydraulic lash adjuster 1192 in a motion receiving end of the rocker arm 1170. The constant hydraulic fluid supply 1190 provides hydraulic fluid to the hydraulic lash adjuster 1192. On the other hand, the selectable hydraulic fluid supply 1180 provides hydraulic fluid to the lost motion assembly in the valve bridge 706. FIG. 11 further illustrates a rocker shaft opening 1195 formed in the rocker arm 1170 and further shows how the constant hydraulic fluid supply 1190 and the selectable hydraulic fluid supply 1180 terminate at the rocker shaft opening 1195, where they would be in fluid communication with suitable constant and switched fluid supplies provided by a rocker arm shaft (not shown).

While particular preferred embodiments have been shown and described, those skilled in the art will appreciate that changes and modifications may be made without departing from the instant teachings. It is therefore contemplated that any and all modifications, variations or equivalents of the above-described teachings fall within the scope of the basic underlying principles disclosed above and claimed herein.

What is claimed is:

1. An apparatus for actuating at least one of two or more engine valves in an internal combustion engine, comprising:

a valve bridge operatively connected to the two or more engine valves; and a hydraulically-actuated lost motion assembly disposed in the valve bridge, the hydraulically-actuated lost motion assembly comprising:

a first piston disposed within a first piston bore formed in the valve bridge and configured to operatively connect with the valve train;

a first biasing element configured to bias the first piston out of the first piston bore, the first biasing element further configured to provide a first force to the first piston that is greater than a second force applied to the first piston by a lash adjuster; and a travel limiter configured to limit travel of the first piston out of the first piston bore, wherein the lash adjuster is disposed upstream of the hydraulically-actuated lost motion assembly in a valve train configured to be operatively connected to a valve actuation motion source and to the valve bridge.

2. The apparatus of claim 1, wherein the first piston comprises an internal cavity configured for fluid communication with a hydraulic fluid supply, and further comprising:

a check valve disposed in the internal cavity and configured to permit one-way flow of hydraulic fluid from the hydraulic fluid supply into the internal cavity and the first piston bore.

3. The apparatus of claim 2, wherein the hydraulic fluid supply comprises a selectable hydraulic fluid source.

4. The apparatus of claim 3, further comprising:

a reset assembly comprising:

a reset valve disposed in the valve bridge in fluid communication with first piston bore; and a fixed reaction surface configured to operatively connect with the reset valve, thereby opening and closing the reset valve.

5. The apparatus of claim 3, wherein the valve bridge further comprises a slave piston disposed in a slave piston bore formed in the valve bridge, a hydraulic circuit formed in the valve bridge in fluid communication with the first piston bore and the slave piston bore.

6. The apparatus of claim 5, further comprising:

a reset assembly comprising:

a bleed hole formed in the valve bridge in fluid communication with slave piston bore; and a fixed reaction surface configured to operatively connect with the valve bridge thereby providing selective sealing engagement with the bleed hole.

7. The apparatus of claim 2, wherein the hydraulic fluid supply comprises a constant hydraulic fluid source.

8. The apparatus of claim 7, further comprising:

a reset assembly comprising:

a reset valve disposed in the valve bridge in fluid communication with first piston bore; and an actuator configured to selectively open and close the reset valve.

9. A system for actuating the two or more engine valves comprising the apparatus of claim 1, and further comprising:

a hydraulic fluid supply to the lost motion assembly, wherein the hydraulic fluid supply is provided via a component of the valve train operatively connected to and in fluid communication with the lost motion assembly, the hydraulic fluid supply configured independent of another hydraulic fluid supply for the hydraulic lash adjuster.

10. A system for actuating the two or more engine valves comprising the lost motion assembly of claim 1, and further comprising:

a hydraulic fluid supply to the lost motion assembly, wherein the hydraulic fluid supply is provided via a component of the valve train operatively connected to and in fluid communication with the lost motion assembly, the hydraulic fluid supply configured to also supply the hydraulic lash adjuster.

11. The system of claim 10, the hydraulic lash adjuster further comprising:

a lash adjuster housing having a lash piston bore configured for fluid communication with the hydraulic fluid supply;

a lash piston slidably disposed in the lash piston bore and forming a chamber between the lash adjuster housing and the lash piston, the lash piston having an internal cavity configured for fluid communication with the hydraulic fluid source and having an opening between the internal cavity and the chamber; and a check valve disposed in the chamber and configured to permit one-way flow of hydraulic fluid via the lash piston bore, internal cavity and opening into the chamber, wherein the lash adjuster housing further comprises a first hydraulic fluid passage configured for fluid communication with the hydraulic fluid supply, the first hydraulic fluid passage further configured to bypass the lash piston bore, lash piston and check valve and to provide hydraulic fluid to an output port configured for fluid communication with the lost motion assembly.

12. The system of claim 11, wherein the valve train comprises a rocker arm having a second hydraulic fluid passage and a lash adjuster bore formed in the rocker arm, wherein the lash adjuster housing is disposed within the lash adjuster bore such that the second hydraulic fluid passage serves as the hydraulic fluid supply to the first hydraulic fluid passage.

13. The system of claim 12, the lash adjuster housing comprising a side wall, wherein the first hydraulic fluid passage is configured for fluid communication with the second hydraulic fluid passage via an opening formed in the side wall.

14. The system of claim 12, wherein the lash adjuster bore comprises a lateral hydraulic fluid passage formed in and extending axially along a wall defining the lash adjuster bore, the lateral hydraulic fluid passage providing fluid communication from the second hydraulic fluid passage to the lash adjuster bore.

15. The system of claim 14, wherein the lateral hydraulic fluid passage is configured such that hydraulic fluid from the second hydraulic fluid passage flows more readily through the first hydraulic fluid passage than the lateral hydraulic fluid passage.

* * * * *